US007046937B2

(12) United States Patent
Matsumoto

(10) Patent No.: US 7,046,937 B2
(45) Date of Patent: May 16, 2006

(54) FIXING DEVICE OF IMAGE FORMING APPARATUS EMPLOYING ELECTRO-PHOTOGRAPHIC PROCESS AND CONTROLLING METHOD OF THE SAME

(75) Inventor: Hirotaka Matsumoto, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 109 days.

(21) Appl. No.: 10/806,472

(22) Filed: Mar. 23, 2004

(65) Prior Publication Data

US 2005/0214012 A1 Sep. 29, 2005

(51) Int. Cl.
*G03G 15/20* (2006.01)

(52) U.S. Cl. ..... 399/67; 399/330

(58) Field of Classification Search ..... 399/69, 399/328, 330, 331, 334; 219/216
See application file for complete search history.

(56) References Cited

U.S. PATENT DOCUMENTS 5,862,436 A * 1/1999 Ishizawa et al. ..... 399/69
6,151,462 A * 11/2000 Fukuzawa et al. ..... 399/67
6,650,863 B1 * 11/2003 Fuma ..... 399/329
2004/0086295 A1 * 5/2004 Peng et al. ..... 399/69

FOREIGN PATENT DOCUMENTS

JP 62273591 A * 11/1987
JP 2002-304087 A 10/2002
JP 2003-195680 A 7/2003

* cited by examiner

*Primary Examiner*—Brij B. Shrivastav
(74) *Attorney, Agent, or Firm*—Foley & Lardner LLP

(57) ABSTRACT

At least, a temperature of the surface of a heating roller 13 in a region through which paper of small width passes, and a temperature of the surface of a heating roller 13 in a region through which paper of small width does not pass where paper of large width is carried are detected. Warming up operation is continued, and when a temperature of the surface of a heating roller 13 in the either region reaches a temperature capable of fixing, a ready display is lighted. Thereafter, the surface of the heating roller 13 not having reached a temperature capable of fixing is heated by forcibly lighting a heater lamp till the fixed conditions are satisfied, and at the time of the forcible lighting operation, the surface of the heating roller 13 in a region having reached a temperature capable of fixing is not heated.

6 Claims, 10 Drawing Sheets

| using environment [℃] | temperature at termination of warming up | | ready display (con-pane display) | lamp control |
|---|---|---|---|---|
| | lamp 17 (central portion) | lamp 18 (both ends) | | |
| in excess of 16℃ | $T_A \geqq WUC$ | $T_B < WUS$ | lighted | only lamp 18 (both ends) forcibly turned on |
| | $T_A < WUC$ | $T_B \geqq WUS$ | lighted | only lamp 17 (central) forcibly turned on |
| | $T_A \geqq WUC$ | $T_B \geqq WUS$ | lighted | forcible turn-on not carried out, proceed to normal control |
| less than 16℃ | $T_A \geqq WUC$ | $T_B < WUS$ | not lighted | warming up operation continued |
| | $T_A < WUC$ | $T_B \geqq WUS$ | not lighted | warming up operation continued |
| | $T_A \geqq WUC$ | $T_B \geqq WUS$ | lighted | forcible turn-on not carried out, proceed to normal control |

FIG. 7

FIXING DEVICE OF IMAGE FORMING APPARATUS EMPLOYING ELECTRO-PHOTOGRAPHIC PROCESS AND CONTROLLING METHOD OF THE SAME

BACKGROUND OF THE INVENTION

1. Field of the Invention

The present invention relates to a fixing device in an image forming apparatus employing an electro-photographic process such as a laser printer, an electro-photographic copying machine and the like, and particularly, to a fixing device comprising a heating roller according to a system in which a plurality of heater lamps different in light-distribution characteristics are disposed internally and the surface is divided in region in the lengthwise direction to effect heating, and a control method therefor.

2. Related Art Statement

In an Image forming apparatus 1 employing an electro-photographic system such as a laser printer, an electro-photographic copying machine and the like, as shown in FIG. 1, first, the surface of a photosensitive drum 2 is charged by a charging device 3 to a fixed surface potential, then the surface of the photosensitive drum 2 is exposed by an exposing device 4 such as a semiconductor laser, and the surface potential is decayed to form an electrostatic latent image. And, a bias voltage is applied to the surface of a developing roller 6 of a developing device 5, toner charged within the developing device 5 is adhered to an electrostatic latent image forming section on the surface of the photosensitive drum 2, developed and actualized to form a toner image on the surface of the photosensitive drum 2.

On the other hand, paper P is taken out of a paper cassette 7 by a paper-feed roller 8 and carried by carrying rollers 9, 9, the paper P is charged by a transfer device 10, and a toner image formed on the surface of the photosensitive drum 2 is transferred to the surface of the paper P. Next, the paper P is stripped from the surface of the photosensitive drum 2 by a stripping device 11, the paper P is held by a heating roller 13 and a pressing roller 14 of a fixing device 12, heated and pressed to thereby fixed the toner image on the surface of the paper P, and thereafter the paper P is discharged outside the device by a paper discharging roller 15.

As the aforementioned heating roller 13 of the fixing device 1, there is employed one in which a plurality of heater lamps 17, 18 are disposed internally of an annular tube 16 as shown in FIG. 2. However, recently, the heating roller 13 having a wall-thickness of the annular tube 16 thinned is being used in order to shorten the warming up time.

However, there was a problem that if the wall-thickness of the annular tube 16 is made thin, a change in temperature of the surface of the annular tube 16 becomes great, because of which immediately after termination of the warming up operation, unevenness in temperature occurs in the lengthwise direction of the heating roller 13, whereby poor fixing occurs in an image to be formed on the surface of paper P.

In continuous copying, since paper P being carried takes heat from the surface of the annular tube 16, a difference in temperature occurs in the lengthwise direction of the heating roller 13 depending upon what width of paper P is carried. Particularly, where paper P of small width is carried such as where paper P of A4 size is carried in the longitudinal direction, a temperature abnormally elevates at both ends of the heating roller 13 through which paper P does not pass, whereby parts constituting the heating roller 13 and parts disposed in the periphery thereof become broken; and in copying plural sheets, there was a problem also that a poor image occurs such that a high temperature offset image is formed on the surface of paper P.

For overcoming the problems as noted above, it is contemplated an employment of a heating roller 13 in accordance with a system in which two heater lamps 17, 18 different in light-distribution characteristics are disposed internally of an annular tube 16, and the surface of the heating roller 16 is divided in region in the lengthwise direction to effect heating.

However, even if such a heating roller 13 is employed, when the temperature of the surface of the heating roller 13 is set high in order to overcome the unevenness of temperature in the lengthwise direction of the heating roller 13 immediately after termination of the warming up operation, poor fixing of an image is improved, but there was a problem that the warming up time is unavoidably long.

Further, two heater lamps cannot be lighted simultaneously depending upon the operating conditions due to a problem of flicker or the like, a need occurs to execute a control that the amps are lighted alternately. However, in such a case as described, it is necessary to set the temperature of the surface of the heating roller 13 high immediately after termination of warming up operation in order to prevent poor fixing of an image, thus posing a problem that the warming up time is unavoidably long.

SUMMARY OF THE INVENTION

The present invention has been accomplished, in a fixing device comprising a heating roller according to a system in which a plurality of heater lamps different in light-distribution characteristics are disposed internally and the surface is divided in region in the lengthwise direction and heated, to overcome problems noted with respect to prior art. It is an object of the invention to provide a fixing device in an image forming apparatus without occurring poor image such as poor fixing, and capable of shortening the warming up time, and a control method therefor.

For achieving the above-described object, the control method of a fixing device in an image forming apparatus according to an embodiment of the present invention is characterized by detecting a temperature of the surface of a heating roller in a region through which paper of small width passes, and a temperature of the surface of a heating roller in a region through which paper of small width does not pass where paper of large width is carried; continuing the warming up operation; when the temperature of the surface of the heating roller in either region reaches a temperature capable of fixing, lighting a ready display; thereafter, heating the surface of the heating roller in a region not reaching a temperature capable of fixing by forcibly lighting heater lamps till the fixed conditions are satisfied; and in the forcible lighting operation, not heating the surface of the heating roller in a region that reached the temperature capable of fixing.

BRIEF DESCRIPTION OF THE DRAWINGS

FIG. 7 is a table showing a control method of a heating lamp;

DETAILED DESCRIPTION OF THE INVENTION

An embodiment of a fixing device comprising a heating roller having a plurality of heater lamps disposed will be described in detail hereinafter with reference to the drawings.

Figure 1:
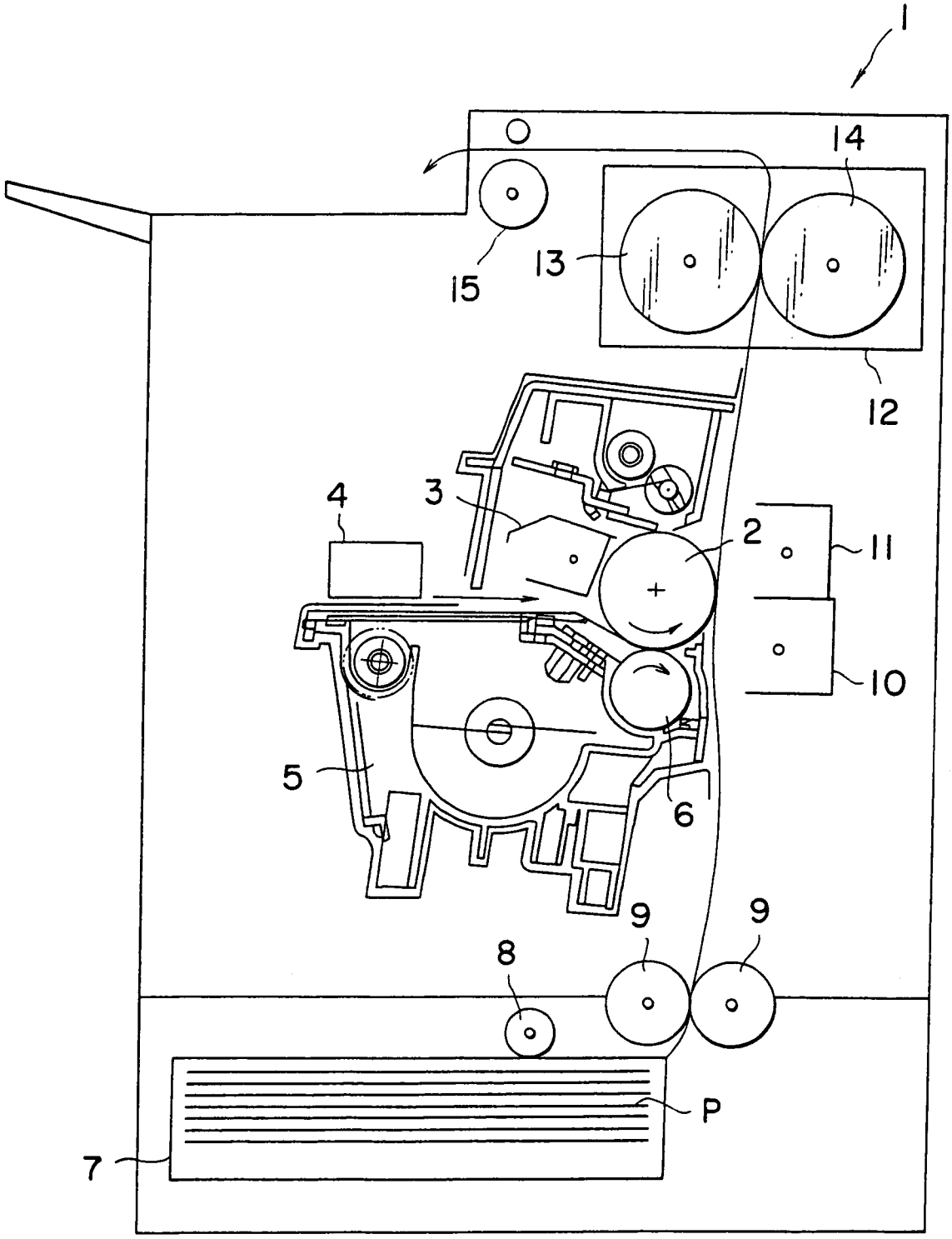
FIG. 1 is a schematic sectional view of an image forming apparatus.
Figure 2:
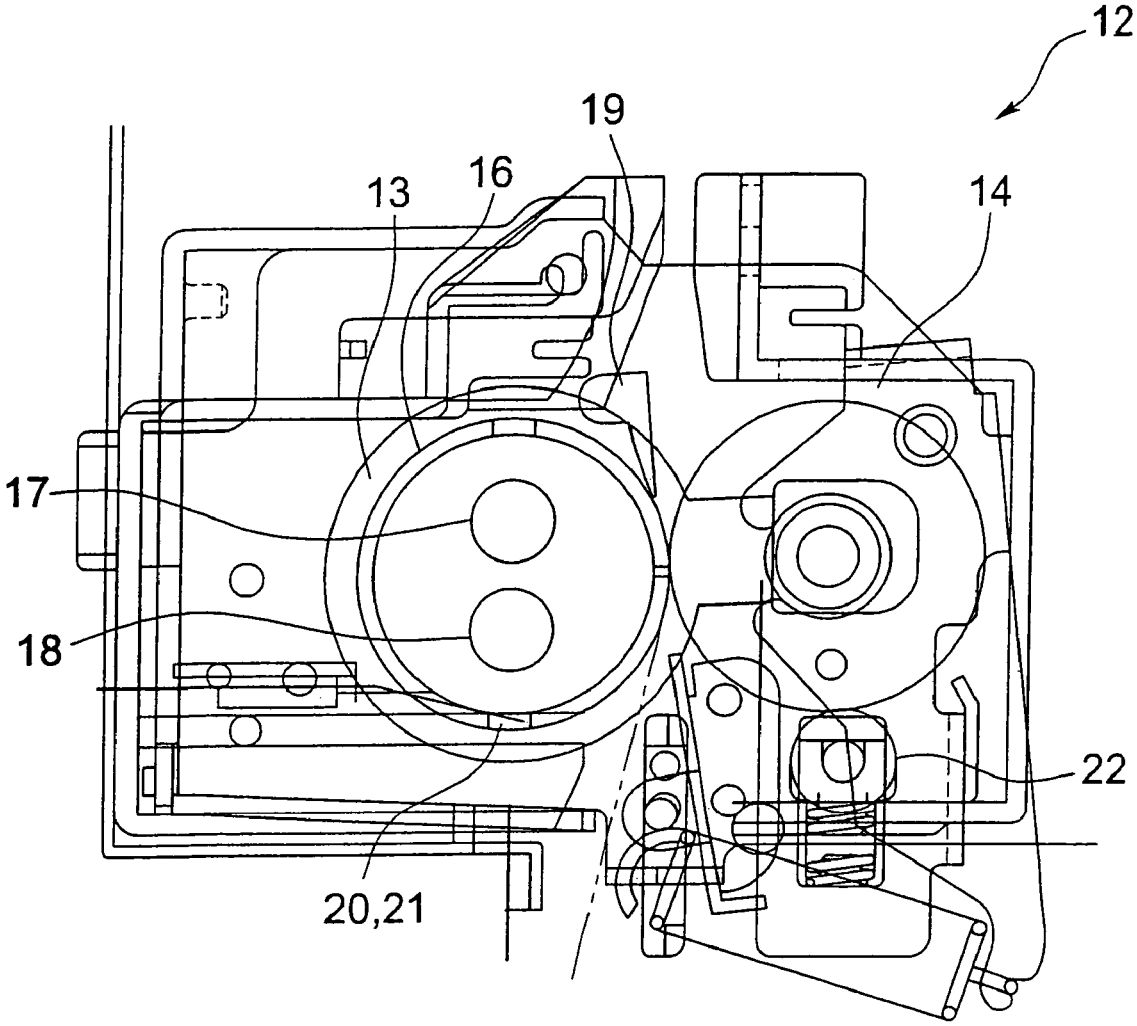
FIG. 2 is a sectional view of a fixing device according to an embodiment of the present invention.

A fixing device 12 is constituted by a heating roller 13 and a pressing roller 14 as shown in FIG. 2.

Figure 3:
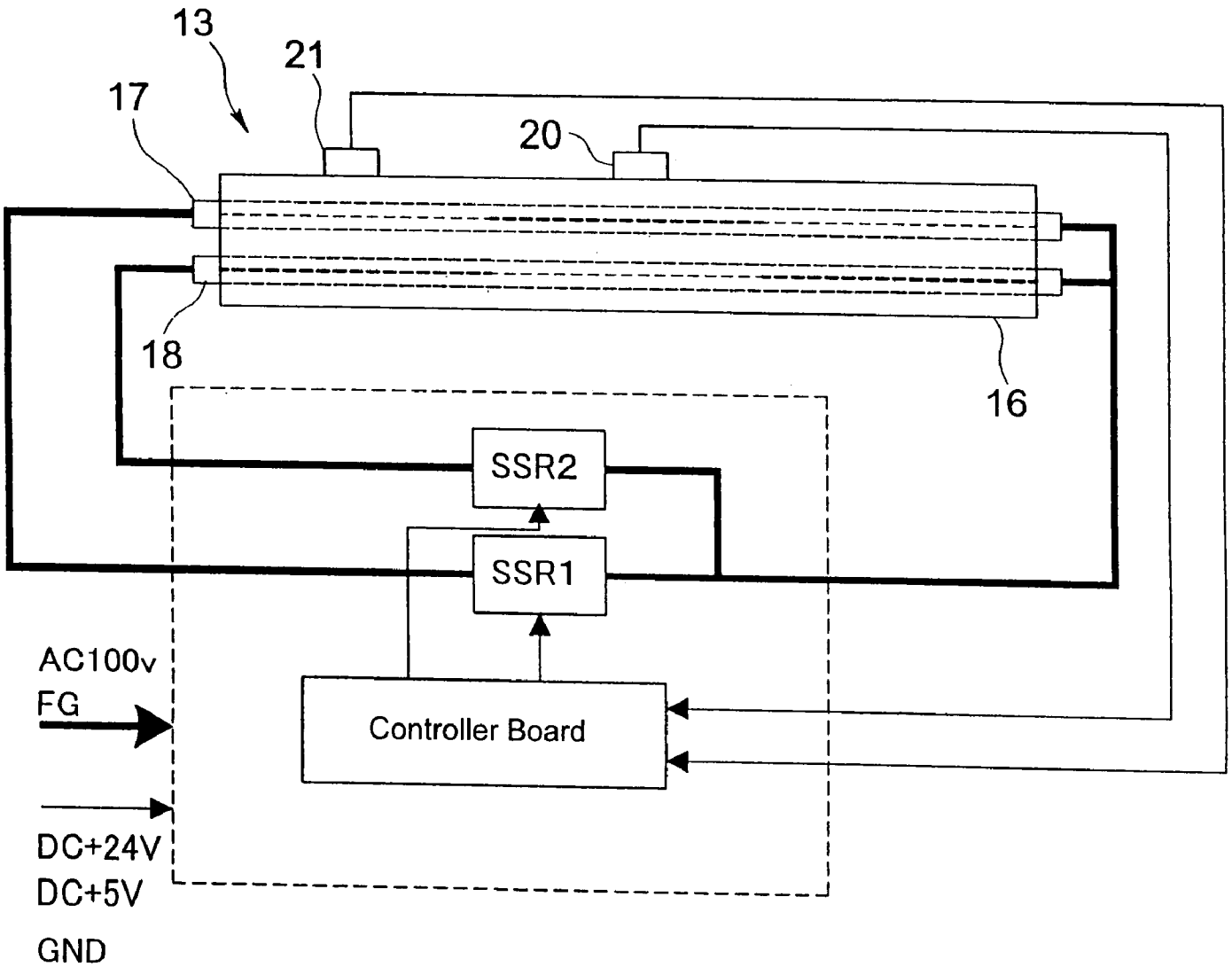
FIG. 3 is an explanatory view showing a schematic structure of a heating roller and a control circuit.

In the heating roller 13, heater lamps 17, 18 are disposed internally of an annular tube 16 having both ends opened, as shown in FIGS. 2 and 3.

The annular tube 16 is formed of aluminum, and formed to have an outside diameter, 30 mm and a wall-thickness, 0.8 mm. Further, its surface is coated with a synthetic resin excellent in release property such as nylon.

Figure 4:
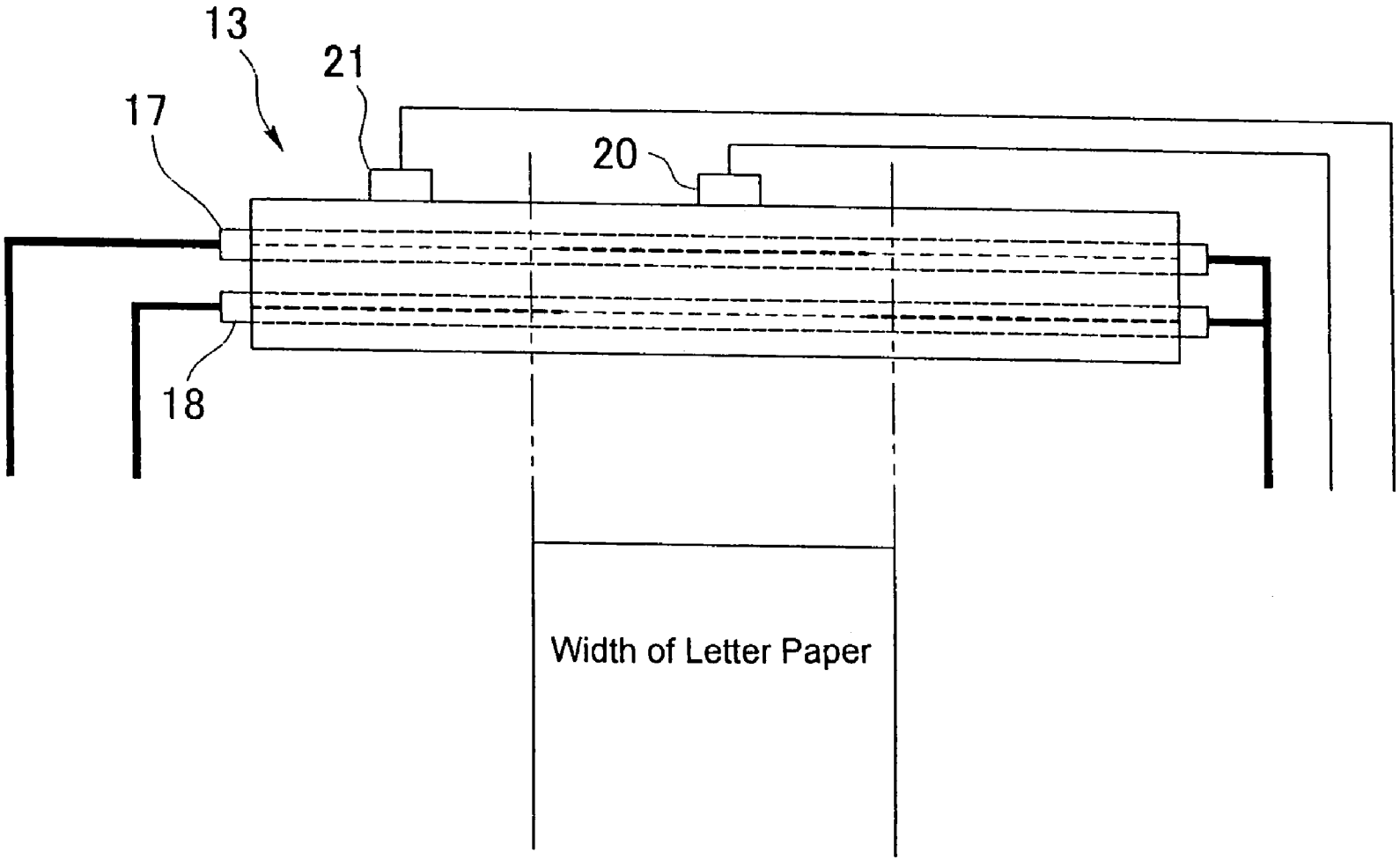
FIG. 4 is an explanatory view showing a relationship between paper width and light-distribution characteristics of a heater lamp.

For two heater lamps 17, 18, halogen lamps are employed, which are arranged in parallel internally of the annular tube 16 as shown in FIG. 3, and light-distribution characteristics of the heater lamps 17, 18 are different in the lengthwise direction of the annular tube 16, As shown in FIG. 4, the heater lamp 17 mainly heats the annular tube 16 in a region through which paper of small width passes (where letter paper is carried in the longitudinal direction, a region through which the letter paper passes), and the heater lamp 18 mainly heats the annular tube 16 in a region through which paper of small width does not pass (where letter paper is carried in the longitudinal direction, a region through which the letter paper does not pass).

In the pressing roller 14, an elastic member having heat resistance such as silicone rubber, fluorine rubber or the like is coated on the outer circumference of a cylindrical body made of iron.

The pressing roller 14 is pressed against the heating roller 13 by a pressing mechanism (not shown) and is set so that the fixed nip width (the width of a contact portion between the heating roller 13 and the pressing roller 14) is maintained. Further, as shown in FIG. 2, the heating roller 13 is rotated in the direction indicated by arrow by a drive motor (not shown), and the pressing roller 14 rotates in the direction indicated by arrow following the former.

And, paper P passes through the contact portion (nip portion) between the heating roller 13 and the pressing roller 14, whereby toner adhered to the surface of paper P is fused and pressed, and fixed to the surface of paper P.

On the outer circumference of the heating roller 13 and at downstream in the rotating direction from the nip portion are disposed a stripping pawl for stripping paper P from the surface of the heating roller 13, and thermisters 20, 21 for detecting a surface temperature of the heating roller 13. Further, on the outer circumference of the pressing roller 14 is disposed a cleaning roller 22 for cleaning the surface of the pressing roller 14.

Figure 5:
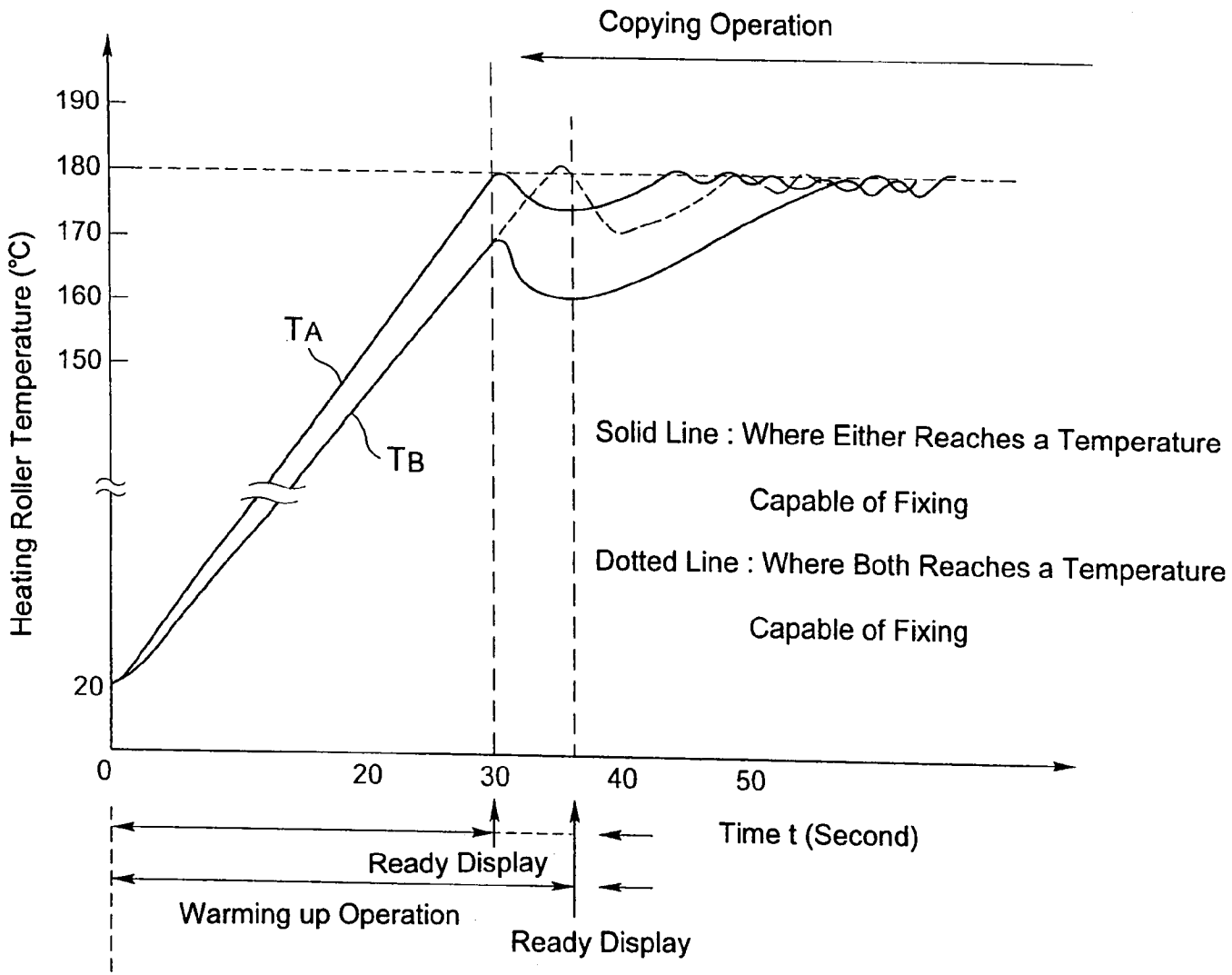
FIG. 5 is an explanatory view showing a relationship between a change in temperature of the surface of a heating roller and warming up time in the conventional fixing device.
Figure 6:
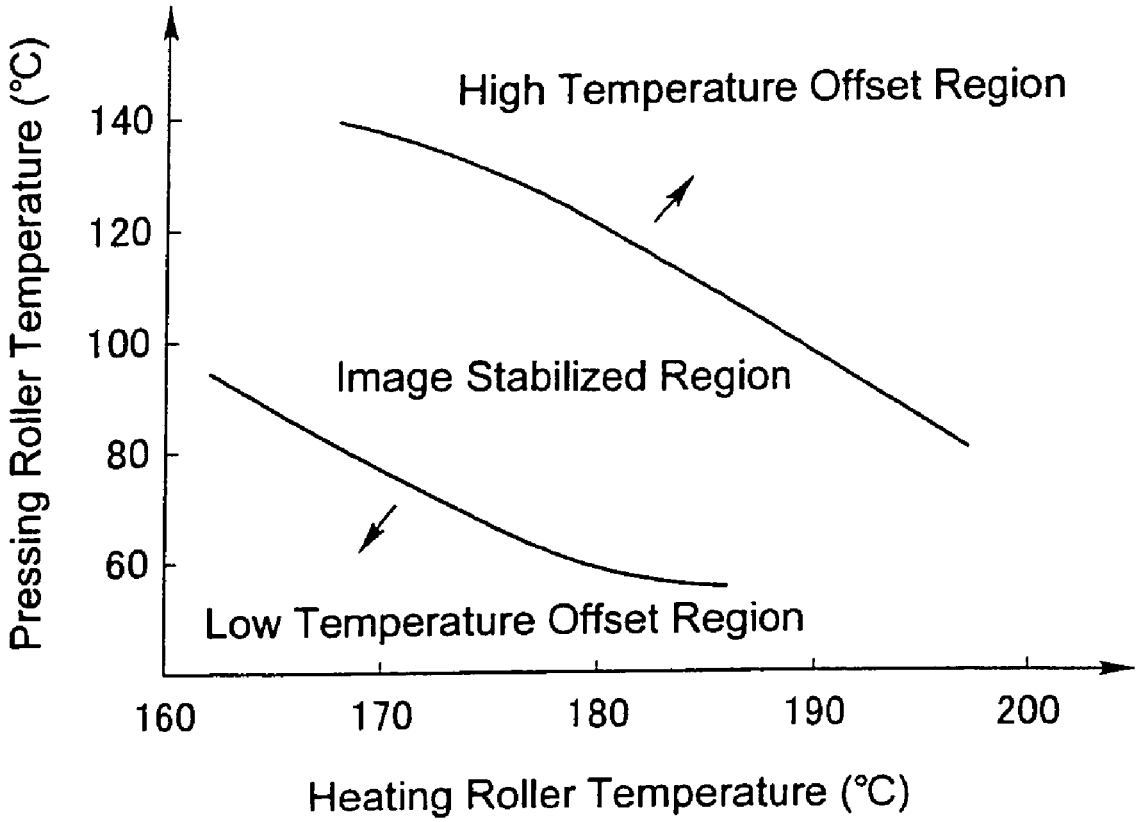
FIG. 6 is an explanatory view showing a relationship between a fixing temperature and a contamination of an image.

FIG. 5 is an explanatory view showing a relationship between a change in temperature of the surface of a heating roller and warming up time in the conventional fixing device; and FIG. 6 is an explanatory view showing a relationship between a fixing temperature and a contamination of an image.

When the power source of the image forming apparatus 1 is turned on, the warming up operation is started, and two heater lamps 17, 18 of the fixing device are lighted simultaneously, to heat a central portion and both ends of the surface of the heating roller 13. At the time of the warming up operation, original reading operation (scanning operation), operation by a main motor (copying operation) or the like are not executed, and therefore sufficient electric power can be used, and two heater lamps 17, 18 can be lighted simultaneously.

When the warming up operation is terminated, and a display capable of being ready for copying (a ready display) is lighted, two heater lamps 17, 18 are lighted alternately, and a temperature of the central portion of the surface of the heating roller 12 and a temperature of the both ends are controlled at a temperature capable of fixing 180° C. by the thermister 20 and the thermister 21, respectively. At the time of copying operation, electric power is used to drive a scan motor, a main motor or the like, and so, two heater lamps 17, 18 cannot be lighted simultaneously.

As will be understood from FIGS. 5 and 6, there was a problem that where when the surface temperature of either the central portion or both ends of the heating roller 13 reaches a temperature capable of fixing, the ready display is lighted, a poor image such as poor fixing occurs due to the temperature unevenness in the lengthwise direction of the heating roller 13 immediately after termination of the warming up operation or under chute phenomenon at the time of copying operation.

On the other hand, where when the surface temperature of both the central portion and both ends of the heating roller 13 reaches a temperature capable of fixing, the ready display is lighted, the warming up temperature naturally is long.

Figure 8:
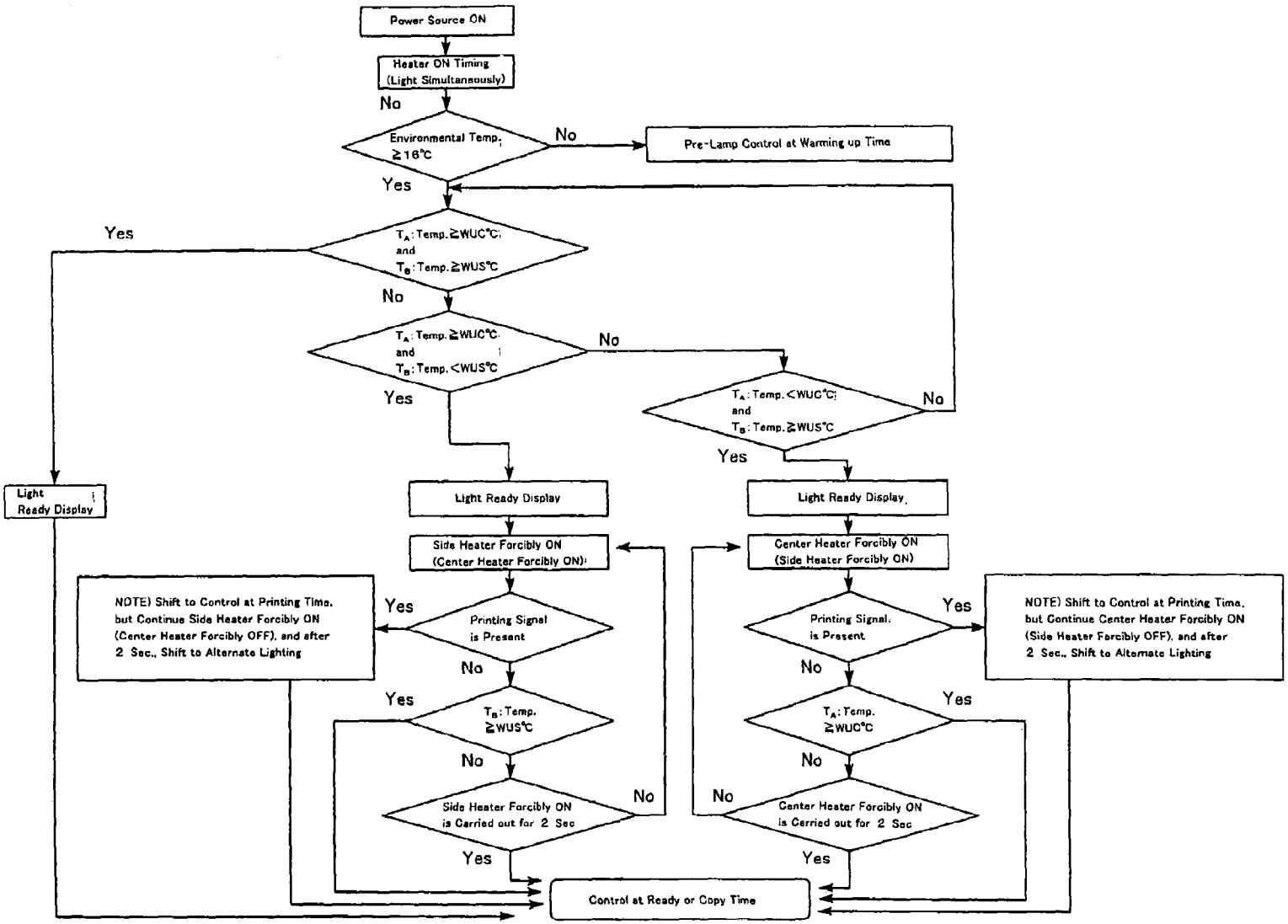
FIG. 8 is a flow chart showing a control method of a heater lamp at the time of normal temperature.
Figure 9:
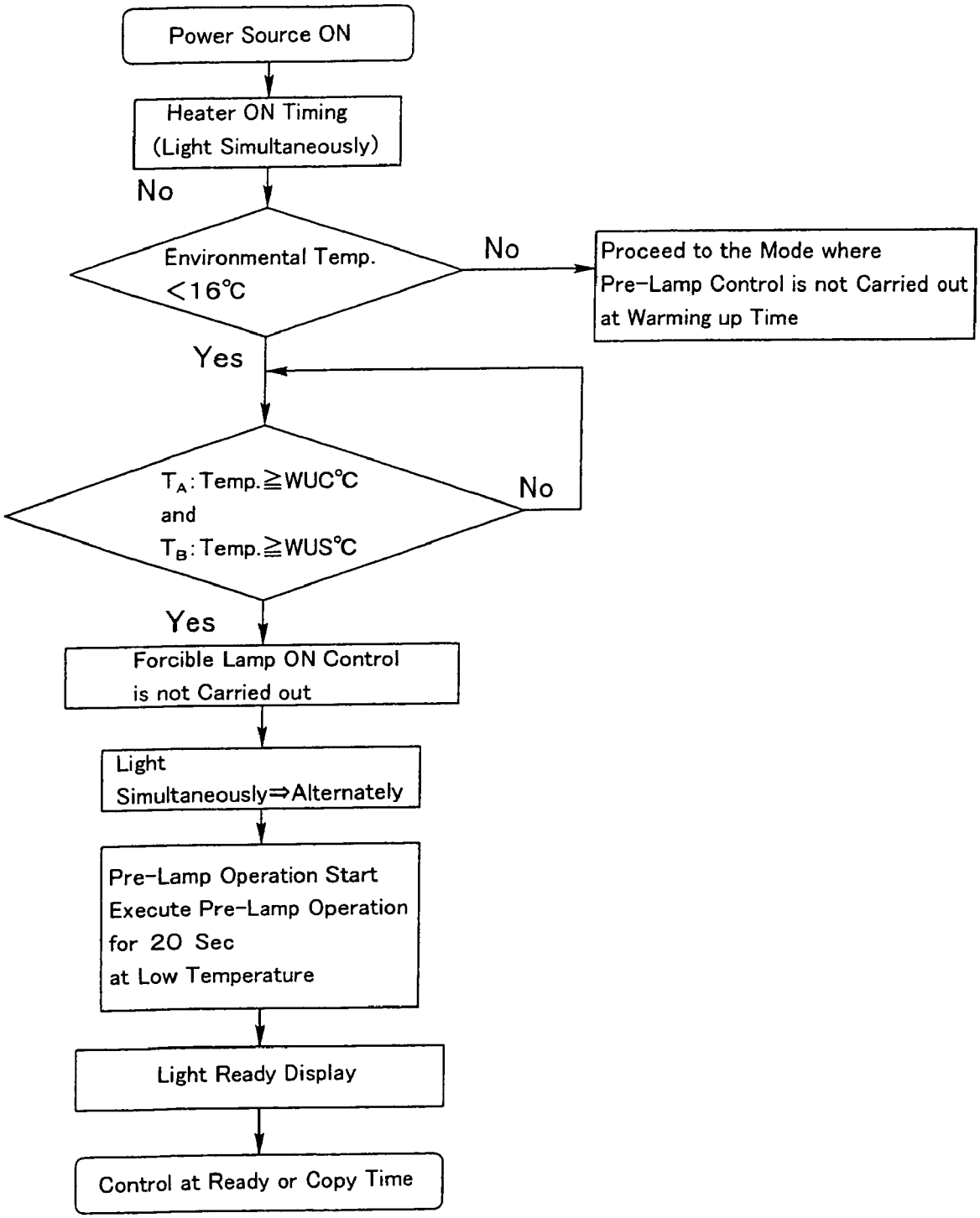
FIG. 9 is a flow chart showing a control method of a heater lamp at the time of low temperature.
Figure 10:
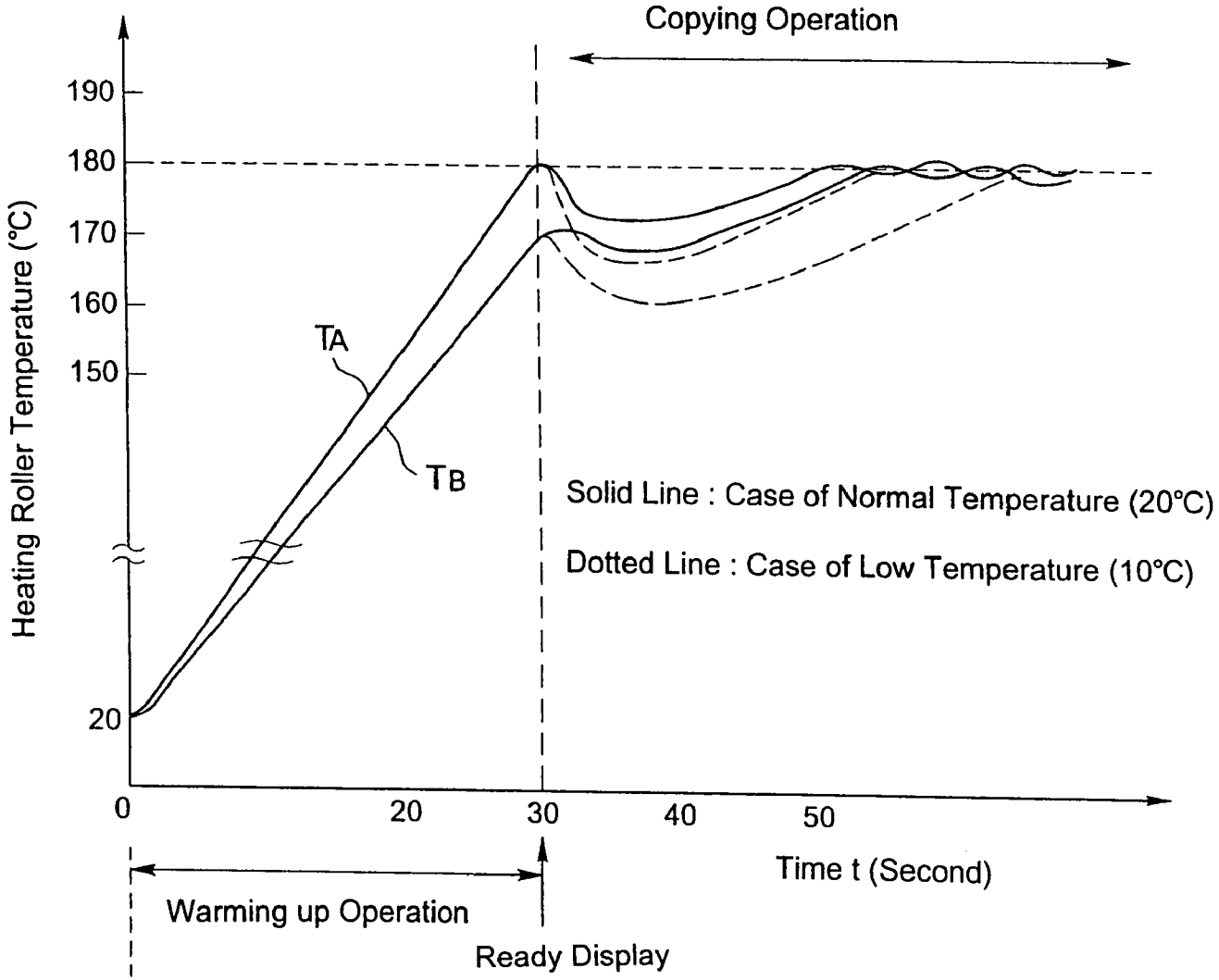
FIG. 10 is an explanatory view showing a relationship between a change in temperature of the surface of a heating roller and warming up time in a fixing device according to an embodiment of the present invention.

In view of the foregoing, in the fixing device of the present embodiment, there is provided an arrangement in accordance with the control method described in FIGS. 7, 8 and 9 wherein when the surface temperature of either central portion or both ends of the heating roller 13 reaches, the ready display is lighted, and only the heater lamp for heating the surface portion of the heating roller 13 not reaching the temperature capable of fixing is forcibly lighted till the fixed conditions are satisfied, whereas at the time of the forcible lighting operation, the heater lamp for heating the surface portion of the heating roller 13 having reached the temperature capable of fixing is not lighted.

With this, a poor image in the lengthwise direction of the heating roller 13 immediately after termination of the warming up operation and under chute phenomenon at the time of copying operation could be reduced, and the poor image such as poor fixing is prevented from occurrence, and the warming up time could be shortened.

The control method of the heater lamp in the fixing device of the present embodiment will be described in detail hereinafter dividing by using environmental temperatures.

Control Method of a Heater Lamp at the Time of Normal Temperature

When the power source of the image forming apparatus 1 is turned on, the warming up operation is started, and two heater lamps 17, 18 of the fixing device 12 are lighted simultaneously, to heat a central portion and both ends of the surface of the heating roller 13.

On the other hand, a using environmental temperature is detected by a thermister (not shown), and where the using environmental temperature is in excess of 16° C., the control method at the time of a normal temperature is executed as shown in FIGS. 7 and 8.

The warming up operation is continued, and when either a temperature ($T_A$) of the central portion of the surface of the heating roller 13 or a temperature ($T_B$) of the both ends reaches a temperature capable of fixing (WUC, WUS), the ready display is lighted.

And, when the temperature ($T_A$) of the central portion reaches the temperature capable of fixing (WUC), only the heater lamp 18 for heating the both ends not reaching the temperature capable of fixing (WUS) is forcibly lighted till the fixed conditions are satisfied, and the heater lamp 17 for heating the central portion having reached the temperature capable of fixing (WUC) is not lighted.

Thereafter, where the temperature ($T_B$) of the both ends reaches the temperature capable of fixing (WUS) or the fixed time has passed from the start of forcible lighting operation, two heater lamps 17, 18 are lighted alternately as in the normal copying, and the operation for controlling the temperature of the central portion of the surface of the heating roller 13 and the both ends to a temperature capable of fixing, 180° C. is executed.

Also, the warming up operation is continued and when the temperature ($T_B$) of the both ends of the surface of the heating roller 13 reaches the temperature capable of fixing (WUS), the operation for forcibly lighting the heater lamp 17 is executed similarly to the above.

The warming up operation is continued, and when both the temperature ($T_A$) of the central portion of the surface of the heating roller 13 and the temperature ($T_B$) of the both ends reach a temperature capable of fixing (WUC, WUS), the ready display is lighted, and the forcible lighting operation as described above is not executed, but two heater lamps 17, 18 are lighted alternately as in the normal copying, and the operation for controlling the temperature of the central portion of the surface of the heating roller 13 and the both ends to a temperature capable of fixing, 180° C. is executed.

At the time of normal temperature, even if the surface portion of the heating roller 13 having reached a temperature capable of fixing is not heated during the surface portion of the heating roller 13 not having reached a temperature capable of fixing is forcibly heated to elevate a temperature, the temperature of the surface portion of the heating roller 13 having reached a temperature capable of fixing is not rapidly lowered.

Therefore, a temperature of both the central portion of the surface of the heating roller 13 and the both ends is held at a temperature in an allowable range capable of fixing, the temperature unevenness in the lengthwise direction of the heating roller 13 and the under chute phenomenon at the time of copying operation are also reduced, the poor image such as poor fixing is prevented from occurrence, and the warming up time can be shortened.

Control Method of a Heater Lamp at the Time of Normal Temperature

When the power source of the image forming apparatus 1 is turned on, the warming up operation is started, and two heater lamps 17, 18 of the fixing device 12 are lighted simultaneously, to heat a central portion and both ends of the surface of the heating roller 13.

On the other hand, a using environmental temperature is detected by a thermister (not shown), and where the using environmental temperature is not more than 16° C., the control method at the time of a low temperature is executed as shown in FIGS. 7 and 9.

The warming up operation is continued, and when both a temperature ($T_A$) of the central portion of the surface of the heating roller 13 and a temperature ($T_B$) of the both ends reach a temperature capable of fixing (WUC, WUS), the ready display is lighted, the forcible lighting operation as described above is not executed, two heater lamps 17, 18 are lighted alternately as in the normal copying, and the operation for controlling the temperature of the central portion of the surface of the heating roller and both ends to a temperature capable of fixing, 180° C.

At the time of a low temperature, unless the surface portion of the heating roller 13 having reached a temperature capable of fixing is heated during the surface portion of the heating roller 13 not having reached a temperature capable of fixing is forcibly heated to elevate a temperature, a temperature of the surface portion of the heating roller 13 having reached a temperature capable of fixing is rapidly lowered.

Therefore, the forcible lighting operation as in normal temperature cannot be executed, and as in the prior art, when both the temperature ($T_A$) of the central portion of the surface of the heating roller 13 and the temperature ($T_B$) of the both ends reach a temperature capable of fixing (WUC, WUS), the ready display is lighted, the operation for lighting two heater lamps 17, 18 alternately is executed.

What is claimed is:

1. A fixing device of an image forming apparatus comprising a heating roller according to a system in which a plurality of heating sources different in light-distribution characteristics are disposed internally, and the surface is divided in regions in the lengthwise direction, wherein:

as said plurality of heating sources, there are provided at least, a heating source for mainly heating a heating roller surface in a first region through which paper of small width passes, and a heating source for mainly heating a heating roller surface in a second region through which paper of small width does not pass where paper of large width is carried;

there are provided at least, a temperature detector for detecting a temperature of a heating roller surface in a region through which paper of small width passes, and a temperature detector for detecting a temperature of a heating roller surface in a region through which paper of small width does not pass where paper of large width is carried; and as warming up operation is continued, temperatures of heating roller surfaces in both the first and the second regions are detected, and when a temperature detected by the temperature detector for detecting a temperature of a heating roller surface in either the first or the second region reaches a temperature capable of fixing, a ready display is lighted.

2. A fixing device of an image forming apparatus comprising a heating roller according to a system in which a plurality of heating sources different in light-distribution characteristics are disposed internally, and the surface is divided in regions in the lengthwise direction, wherein:

as said plurality of heating sources, there are provided at least, a heating source for mainly heating a heating roller surface in a region through which paper of small width passes, and a heating source for mainly heating a heating roller surface in a first region through which paper of small width does not pass where paper of large width is carried;

there are provided at least, a temperature detector for detecting a temperature of a heating roller surface in a second region through which paper of small width passes, and a temperature detector for detecting a temperature of a heating roller surface in a region through which paper of small width does not pass where paper of large width is carried; and as warming up operation is continued, temperatures of heating roller surfaces in both the first and the second regions are detected, and when a temperature detected by the temperature detector for detecting a temperature of a heating roller surface in either the first or the second region reaches a temperature capable of fixing, a ready display is lighted, thereafter only a heating source for mainly heating a heating roller surface in a region not having reached a temperature capable of fixing is forcibly lighted till the fixed conditions are satisfied, and at the time of said forcible lighting operation, a heating source for mainly heating a heating roller surface in a region having reached a temperature capable of fixing is not lighted.

3. The fixing device of an image forming apparatus according to claim 2, wherein a temperature detector for detecting a using environmental temperature is provided, and where a using environmental temperature detected by said temperature detector is in excess of the fixed temperature, warming up operation is continued, temperatures of heating roller surfaces in both the first and the second regions are detected, and when a temperature detected by a temperature detector for detecting a temperature of a heating roller surface in either the first or the second region reaches a temperature capable of fixing, a ready display is lighted, thereafter only a heating source for mainly heating a heating roller surface in a region not having reached a temperature capable of fixing is forcibly lighted till the fixed conditions are satisfied, and at the time of said forcible lighting operation, a heating source for mainly heating a heating roller surface in a region having reached a temperature capable of fixing is not lighted.

4. A control method of a fixing device in an image forming apparatus constituted by a heating roller according to a system in which a plurality of heating sources different in light-distribution characteristics are disposed internally, and the surface is divided in regions in the lengthwise direction, the method comprising:

detecting at least, a temperature of a heating roller surface in a first region through which paper of small width passes, and a temperature of a heating roller surface in a second region through which paper of small width does not pass where paper of large width is carried; and continuing warming up operation, detecting temperatures of heating roller surfaces in both the first and the second regions, and when a temperature of a heating roller surface in said either region reaches a temperature capable of fixing, a ready display is lighted.

5. A control method of a fixing device in an image forming apparatus constituted by a heating roller according to a system in which a plurality of heating sources different in light-distribution characteristics are disposed internally, and the surface is divided in regions in the lengthwise direction, the method comprising:

detecting at least, a temperature of a heating roller surface in a first region through which paper of small width passes, and a temperature of a heating roller surface in a second region through which paper of small width does not pass where paper of large width is carried; and continuing warming up operation, detecting temperatures of heating roller surfaces in both the first and the second regions, and when a temperature of a heating roller surface in said either the first or second region reaches a temperature capable of fixing, a ready display is lighted, thereafter a heating roller surface in a region not having reached a temperature capable of fixing is heated by forcibly lighting a heating source till the fixed conditions are satisfied, and at the time of the forcible lighting operation, a heating roller surface in a region having reached a temperature capable of fixing is not heated.

6. The control method of a fixing device in an image forming apparatus according to claim 5, wherein where a using environmental temperature is in excess of a fixed temperature, the warming up operation is continued, temperatures of heating roller surfaces in both the first and the second regions are detected, and when a temperature of a heating roller surface in said either the first or the second region reaches a temperature capable fixing, a ready display is lighted, thereafter a heating roller surface in a region not having reached a temperature capable of fixing is heated by forcibly lighting a heating source till the fixed conditions are satisfied, and at the time of the forcible lighting operation, a heating roller surface in a region having reached a temperature capable of fixing is not heated.

* * * * *